United States Patent [19]

Schlindwein

[11] Patent Number: 4,704,880

[45] Date of Patent: Nov. 10, 1987

[54] REMOVABLE CAM-LOCK UNIT AND DEAD-BOLT MECHANISM

[76] Inventor: Siegfried Schlindwein, 51 St. Mary Dr., Succasunna, N.J. 07876

[21] Appl. No.: 940,213

[22] Filed: Dec. 8, 1986

Related U.S. Application Data

[63] Continuation of Ser. No. 743,310, Jun. 10, 1985, abandoned.

[51] Int. Cl.[4] ..... E05B 63/14; E05B 9/04; E05G 1/04; E05C 1/12

[52] U.S. Cl. ..... 70/120; 109/52; 292/170; 70/368; 70/371

[58] Field of Search ..... 70/120, 134, 370, 371, 70/DIG. 20, DIG. 27, 361, 368; 109/52, 59 R, 59 T; 292/170, 37

[56] References Cited

U.S. PATENT DOCUMENTS

| | | | |
|---|---|---|---|
| 1,207,123 | 12/1916 | Arsneau | 292/170 |
| 1,287,973 | 12/1918 | Gruber | 292/170 |
| 1,534,584 | 4/1925 | Fredrick | 292/37 |
| 1,901,613 | 3/1933 | Smith | 292/37 |
| 1,941,225 | 12/1933 | Radke et al. | 292/37 |
| 2,690,144 | 9/1954 | Ellis et al. | 292/37 |
| 2,905,493 | 9/1959 | Tocchetto | 292/170 |
| 3,792,884 | 2/1974 | Tutikawa | 292/37 |
| 3,919,866 | 11/1975 | Lipschutz | 292/170 |
| 4,370,873 | 2/1983 | Edmunds | 70/371 |
| 4,484,462 | 11/1984 | Berkowitz | 70/368 |
| 4,547,006 | 10/1985 | Castanier | 292/170 |
| 4,559,880 | 12/1985 | Lacka | 292/37 |

FOREIGN PATENT DOCUMENTS

| | | | |
|---|---|---|---|
| 1553347 | 10/1970 | Fed. Rep. of Germany | 292/37 |
| 417013 | 12/1946 | Italy | 292/37 |

OTHER PUBLICATIONS

Medco Security Locks, pp. 91–92, "T Handle Cylinder Locks".

*Primary Examiner*—Gary L. Smith
*Assistant Examiner*—Vinh Luong

[57] ABSTRACT

Dead-bolt locking apparatus includes a door-carried dead-bolt mechanism having oppositely projecting dead-bolts on dual aligned slides, and a key-controlled cam-lock unit receivable in a cavity in the dead-bolt mechanism. The cam-lock unit is inserted into the cavity with the lock of the cam-lock unit "unlocked", developing balanced outward thrust on the door-securing dead-bolt slides. Locking the cylinder lock then secures the cam-lock unit against removal and thereby locks the dead-bolt apparatus.

10 Claims, 9 Drawing Figures

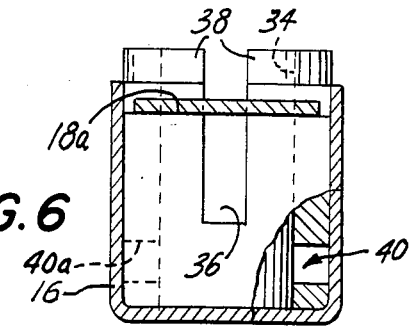
FIG. 6
FIG. 4
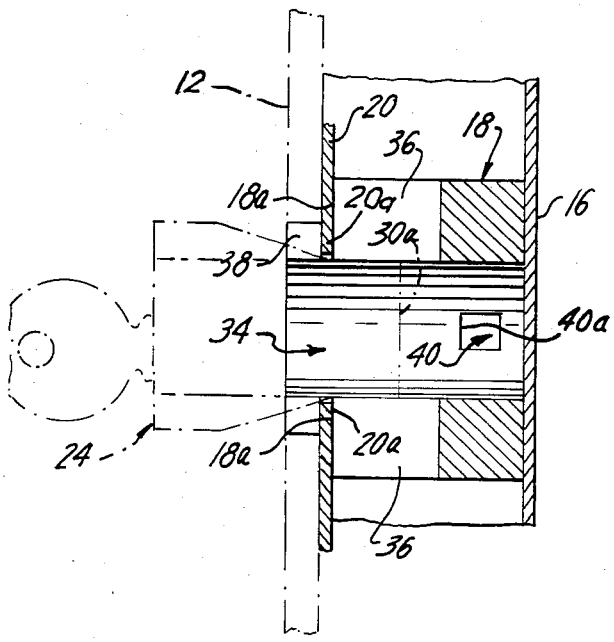
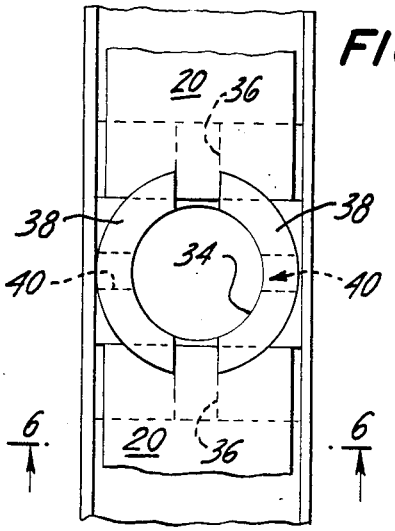
FIG. 5
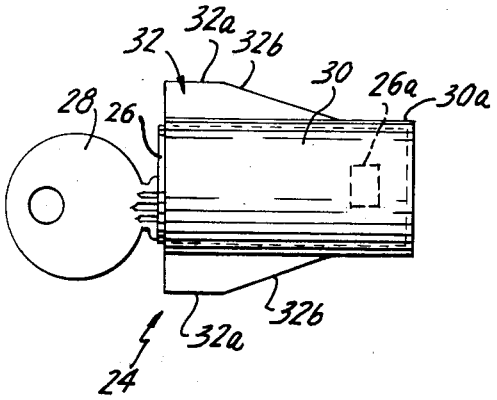
FIG. 7
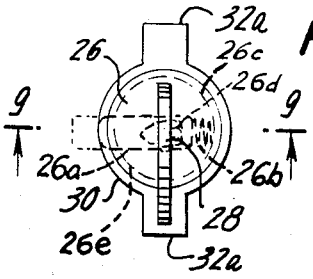
FIG. 8
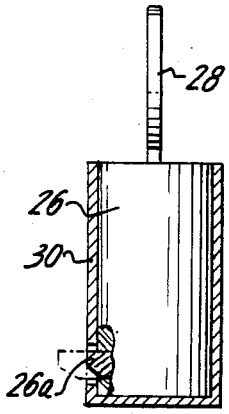
FIG. 9

REMOVABLE CAM-LOCK UNIT AND DEAD-BOLT MECHANISM

This application is a continuation of application Ser. No. 743,310 filed June 10, 1985, now abandoned.

This invention relates to key-controlled apparatus for locking a closure, especially the door of a safe.

In common practice, many hotels offer their patrons the use of a locked box in a central safe for storing valuables. The capacity of such locked boxes is usually quite small so that even moderately bulky items of value must still be stored at risk in the patron's room.

An object of this invention resides in providing a novel locking apparatus at low cost but with a high level of security for safes and other purposes. These safes may be fixed installations in hotel rooms and elsewhere such as the residences of college students.

The novel locking apparatus detailed below and shown in the accompanying drawings includes a dead-bolt mechanism that is installed securely in a safe plus a portable cam-lock unit. The term "safe" as used here means a tough enclosure suitable for storing valuables, one that is designed to frustrate entry. The novel dead-bolt mechanism is ordinarily fixed to the door of the safe. It has dual opposite dead bolts that are spring-retracted, but which are projected to secure the door closed. The dead-bolt mechanism has a base formed with a cavity to receive the portable cam-lock unit. Insertion of the cam-lock unit into the cavity drives two dead bolts in opposite directions into their door-securing positions.

The cam-lock unit contains a cylinder lock operable by a key. Operating the key to index the lock cylinder serves to lock the cam-lock unit in place in the cavity, and locks the dead-bolt apparatus. The key is then removed, leaving the cam-lock unit locked in the cavity with the door secured by the dead bolts.

Inserting the cam-lock unit into the cavity involves applying moderate effort to project the dead bolts outward. The cam-lock unit applies oppositely directed balanced thrust to locking slides of the dead-bolt mechanism. Little effort is needed to insert the cam-lock unit to drive the locking slides outward for locking the door. Operating the key needs only slight effort.

First cam elements at opposite sides of the cam-lock unit bear against second cam elements of the oppositely directed dead-bolt locking slides. If a thief were to try to force one of the dead-bolt slides inward along its length, by locating that dead bolt and pounding it in an attempt to force and release the dead-bolt mechanism, the dead-bolt slide would be blocked by the essentially solid cam-lock unit received in the base of the dead-bolt mechanism. Moreover, the second dead bolt and its supporting slide at the opposite side of the cam-lock unit would remain fully effective to maintain the door securely closed.

The cam-lock unit for one dead-bolt mechanism is useable interchangeably in all the other dead-bolt mechanisms of a typical installation. Each cam-lock unit assigned to a person is unique, so that a safe in any room becomes unique to the occupant to the same extent that the cylinder lock and key of the assigned cam-lock unit is unique.

An illustrative embodiment of the invention is shown in the accompanying drawings and described in detail below together with further features and advantages of the invention.

In the drawings:

FIG. 4 is a fragmentary cross-section of the dead-bolt mechanism viewed as in FIG. 3, drawn to larger scale, with the safe door and the just-entering cam-lock unit in phantom lines;

FIG. 5 is a fragmentary front elevation of the dead-bolt mechanism of FIGS. 1—4, as seen from the left of FIG. 4;

FIG. 6 is a cross-section of the dead-bolt mechanism of FIGS. 1–5, generally as seen from the plane 6—6 in FIG. 5;

FIG. 7 is a side elevation of the cam-lock unit of FIGS. 1 and 2, drawn to larger scale;

FIG. 8 is a front view of the cam-lock unit, as seen from the left of FIG. 7; and FIG. 9 is side elevation of the cam-lock unit of FIGS. 7 and 8, showing the lock receptacle in cross-section as seen at the plane 9—9 of FIG. 8.

DESCRIPTION OF THE ILLUSTRATIVE EMBODIMENT

Figure 1:
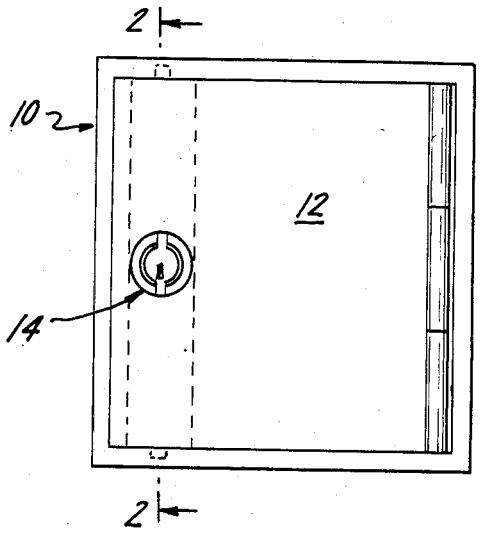
FIG. 1 is a front elevation of a safe equipped with an embodiment of the novel locking apparatus.

The safe 10 of FIG. 1 has a door 12 equipped with locking apparatus 14. The bottom of the safe is securely bolted to the floor, thus guarding the safe against removal and protecting the bottom of the safe against access by would-be tamperers.

Figure 2:
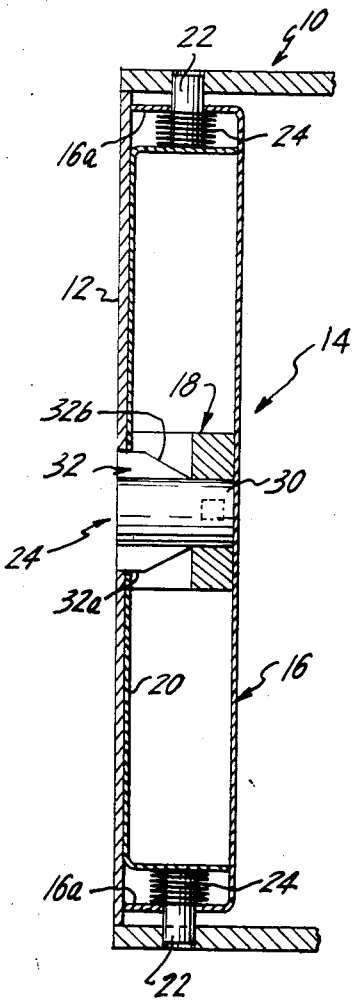
FIG. 2 is a fragmentary vertical cross-section of the safe of FIG. 1 at the plane 2—2 therein and drawn to larger scale, the locking apparatus being shown in its locking configuration.

Door 12 is locked by the mechanism 14 of FIG. 2. That mechanism includes a channel 16 (see also FIG. 6) that is suitably secured to door 12, as by welding. Block 18 is welded to the bottom and side walls of channel 16 midway between the ends of the channel. Channel 16 and block 18 form a base of the mechanism.

Figure 3:
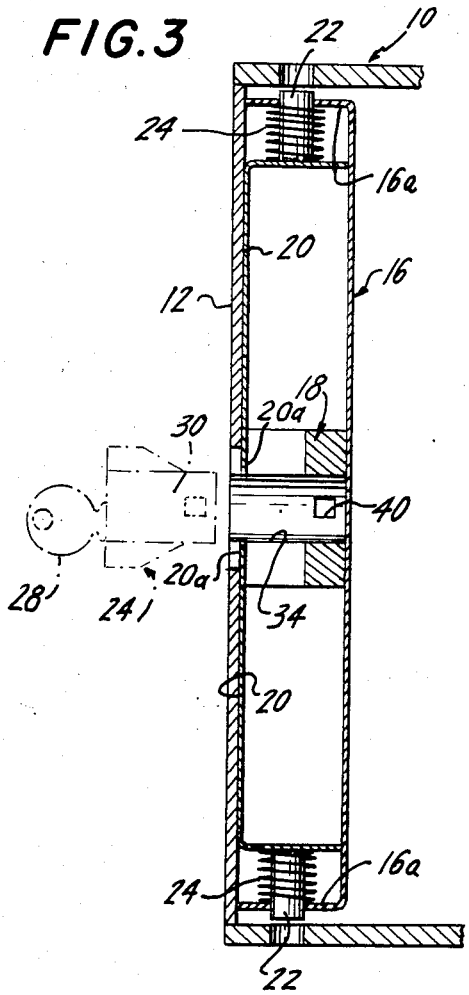
FIG. 3 is a view like FIG. 2, with the cam-lock unit removed from the dead-bolt mechanism of the locking apparatus and shown in phantom lines.

Two dead-bolt slides 20, confined in channel 16 behind door 12, bear dead-bolts 22 which slide in holes in end walls **16*a* of channel 16. Each slide 20 and its dead-bolt 22 may be called a "locking slide." In FIG. 2, dead-bolts 22 are shown received in holes in the top and bottom walls of safe 10. Of course, those holes are aligned with the bolt-guiding holes in end walls 16*a* of the channel. End portions 20*a* of slides 20 (remote from their bolts) are guided between door 12 of the safe and shoulders 18*a* of block 18. Compression coil springs 24 around dead-bolts 22 are confined between respective walls 16*a* and slides 20, for biasing bolts 22 toward their retracted positions (FIG. 3**).

A cam-lock unit 24 (FIGS. 7, 8 and 9) forms a portable portion of the door-locking apparatus. Unit 24 includes a cylinder lock 26 fitted with a key 28. For example, this is a T-handle cylinder lock #64-0150 made by Medeco Security Locks, Inc., of Salem, Va. Lock 26 has a latch or bolt **26*a* that is biased outward by spring 26*b*. Latch 26*a* is shown in solid lines in FIG. 9 in its retracted position and in phantom lines when projected. Cylinder lock 26 includes a key-operable cylinder 26*c* that is rotated or indexed within the stationary shell 26*e* of the cylinder lock by key 28. Turning key 28 operates an internal rotor or lock cylinder 26*c* of cylinder lock 26, thereby orbiting pin 26*d* and causing latch 26*a* to assume its projected position. The internal mechanism of cylinder lock 26** is shown only diagrammatically.

Cylinder lock 26 has a sliding fit in a cylindrical cavity of body 30 of the cam-lock unit. Body 30 and shell 26*e* serve as a composite body portion of unit 24 containing key-operable lock cylinder 26*c*. Latch 26*a* in its retracted position is received in a hole in body 30, retaining the cylinder lock in the body as part of cam-lock unit 24. In that position bolt 26*a* is roughly flush with the exterior of body 30. Cylinder lock 26 is installed in body 30 by pushing latch 26*a* inward as the cylinder lock is being slipped into body 30. When the lock is fully inserted (FIG. 9), latch 26*a* snaps out, retaining the lock securely in the body. The lock can be removed from the body—although this is not done in the routine use of the apparatus—by depressing latch 26*a* as the lock is being withdrawn from the body. When the lock is fully installed, its face at which the key is admitted is roughly flush with the surrounding portion or front edge of the body.

Two diametrically opposite cams 32 project fixedly from the generally cylindrical exterior of body 30. As shown in FIGS. 6 and 7, cams 32 are directed oppositely away from the axis of lock cylinder 26*c* and are disposed fixedly and externally on opposite sides of that portion of body 30 which contains cylinder lock 26. Those cams include respective end segments 32*a* parallel to the axis of cylinder 26*c*. Those segments extend to the front edge of the body surrounding lock 26. Cams 32 also have ramps 32*b* that slope from the generally cylindrical exterior of body 30 outward to end segments 32*a*.

The dead-bolt mechanism which receives the portable cam-lock unit 24 is shown in FIGS. 1–6. As best seen in FIGS. 4–6, block 18 forms part of the base of that mechanism. Block 18 has a cylindrical cavity 34 whose axis is perpendicular to flat door 12. The cylindrical exterior of body 30 of cam-lock unit 24 (FIG. 7) has a sliding fit in cavity 34. Block 18 has diametrically opposite slots 36 for receiving cams 32 of the cam-lock unit. Door 12 has a circular hole that is largely filled by a divided annular formation 38 of block 18. That formation is flush with the outside surface of door 12. The inside diameter of formation 38 is aligned with and forms an extension of cavity 34. Slots 36 in block 18 extend to the outside surface of formation 38, dividing it into two arcs of an annulus. The outer diameter of formation 38 equals the separation between opposite cam segments 32*a*. Block 18 thus provides a cylindrical cavity 34 and opposite slots 36 that extend to the exterior for admitting cam-lock unit 24. When the cam-lock unit is in place in cavity 34, structure 38 complements cams 32 in providing an attractive appearance and one that is closed and flat at the front.

In the condition of the mechanism as shown in FIGS. 4–6 (cam-lock unit 24 removed), end portions 20*a* of the dead-bolt slides 20 abut block 18 so that the ends of dead-bolt slides 20 are essentially aligned with cavity 34. The cylindrical end portion 30*a* of cam-lock unit 24 is inserted into cavity 34 and, as cam lock unit 24 is pushed all the way in, cams 32*b* press against the ends 20*a* of slides 20. Accordingly, a first pair of cam elements 32*b* of the cam-lock unit 24 cooperate with a second pair of cam elements (ends 20*a* of locking slides 20) to drive the locking bolts 20, 22 outward as the cam-lock unit 24 is driven into cavity 34 of block 18. Cams 32*b* force slides 20 outward so that dead-bolts 22 shift into complementary holes in the walls of the safe. Dual slides 20 exert balanced reaction forces against cam-lock unit 24 during its insertion. The manual effort applied to unit 24, aided by the cams, drives the dead bolt slides 20 outward. The door of the safe is releasably held closed simply by inserting the cam-lock unit 24.

When cam-lock unit 24 is to be inserted, locking cylinder 26*c* is indexed about the cylinder axis so that latch 26*a* is retraced as shown in solid lines in FIG. 9. Block 18 has a pair of diametrically opposite holes 40 located so that, when the cam-lock unit has been inserted fully, one hole 40 or the other will be positioned in alignment with latch 26*a*. Each cam 32 in its slot 36 locates cam-lock unit 24 so that latch 26*a* is aligned with a hole 40.

The user may merely leave unit 24 in place, with door 12 held closed by bolts 22 and with the entire cam-lock unit (including key 28) stored in place.

Lock 26 is of the well-known type wherein the key is held captive against removal from the lock when the lock is unlocked, i.e. when latch 26*a* is retracted, as represented in FIG. 9, solid lines. Consequently, the entire cam-lock unit is readily removed from the door using key 28 as a handle whenever the door is to be released and opened.

Whenever the safe is to be locked, key 28 is turned, indexing cylinder 26*c* to cause spring-biased lock 26*a* to be projected into one of the holes 40. The portion of block 18 that forms the left-hand side of hole 40 as shown in FIG. 4 constitutes an abutment 40*a* that is cooperable with latch 26*a*. The abutment prevents the cam-lock unit 24 being removed from dead-bolt mechanism when the cam lock unit has been inserted into cavity 34 and the cylinder lock has been indexed so as to cause latch 26*a* to project into hole 40. The door is then locked shut because the cam-lock unit is locked against removal. The key is released when the cylinder lock is thus in its locked condition. The key may then be carried away by the user.

In the locked configuration of the mechanism as shown in FIG. 2, any effort at forcing the safe open by beating against the upper bolt 22 is resisted by the sturdy assembly of cam-lock unit 24 in base or block 18. Thrust developed by the upper slide 20 against unit 24 in block 18 is firmly resisted. Upper cam 32 is supported by body 30, and in turn, the body is virtually filled by the nearly solid structure of lock 26. The whole unit fills cavity 34 and is securely supported in block 18. Even if the upper bolt 22 could be forced, somehow, out of cooperation with the safe's upper wall, the lower bolt 22 remains inaccessible and fully effective to hold the door locked. The described locking bolt mechanism thus provides a high level of security.

A safe of this kind may be installed in a hotel room, or as a gym locker, and then the complete cam-lock units including their respective keys can be stored at a central desk. Any cam-lock unit issued to a user serves to personalize any safe or locker to the individual user. Before the user can open the safe to remove his belongings, he is compelled to remove the cam-lock unit from the safe. The bulk of the cam-lock unit serves as a reminder to the user to return the unit to the central desk.

The illustrative embodiment of the invention described above and shown in the accompanying drawings may well be modified and rearranged by those skilled in the art. Therefore the invention should be construed broadly in accordance with its true spirit and scope.

What is claimed is:

1. Dead-bolt locking apparatus for releasably locking a door of an enclosure in closed position, said apparatus including a removable cam-lock unit having a key, a key-controlled cylinder lock, said cylinder lock having a lock cylinder rotatable about its axis, said cam-lock unit comprising a body portion containing said lock cylinder, and a latch operated by said lock cylinder between a projecting locking position and a position retracted from said locking position in dependence on indexing of the lock cylinder about its axis to first and second positions, respectively, said body portion fixedly bearing a pair of first cam elements directed oppositely relative to the axis of said cylinder, and said latch moving relative to said body portion and relative to said first cams between said locking position and said retracted position, and a dead-bolt mechanism having a base providing a cavity shaped for admitting and guiding said cam-lock unit via an outer end of the cavity and along the axis of the lock cylinder, said base including an abutment which cooperates with said latch so as to prevent removal of said removable cam-lock unit from said base when insertion of the cam-lock unit into said cavity has been completed and when, thereafter, the cylinder lock has been operated to cause said latch to assume its locking position in cooperation with the abutment, said dead-bolt mechanism including a pair of oppositely reciprocable locking bolts having retracted positions and projected positions, said locking bolts having respective second cam elements adjacent said cavity and cooperable with said first cam elements, respectively, and spring means for biasing said locking bolts to their retracted positions and for retracting said second cam elements toward each other when the cavity is empty, the foregoing apparatus being arranged so that the effort of inserting the cam-lock unit into the cavity develops balanced mutually opposite thrust of the first cam elements against the second cam elements as the cam-lock unit is being received in said cavity, thereby driving said locking bolts oppositely to their projecting positions, whereupon indexing of said lock cylinder by said key into its first position causes the latch to assume said locking position, thereby locking the cam-lock unit against removal from the cavity and thus locking said locking bolts in their projected positions.

2. Dead-bolt locking mechanism as in claim 1 wherein said locking bolts include mutually aligned slide portions and respective oppositely directed locking projections on said slide portions remote from said second cam elements, respectively, and wherein said base provides aligned slide bearings for said slide portions.

3. Dead-bolt locking mechanism as in claim 2 wherein said spring means comprises compression coil springs disposed about said locking projections and arranged to bias said slide portions toward said cavity.

4. Dead-bolt locking apparatus for releasably locking a door of an enclosure in closed position, said apparatus including (I.) a removable cam-lock unit having (i.) a key, a key-controlled cylinder lock including a lock shell and a cylinder in the shell indexing about the axis of the cylinder in relation to said shell, (ii.) a body containing said cylinder lock, and (iii.) a latch operated by said cylinder lock between a projecting locking position and a released position retracted from said locking position in dependence on indexing of the cylinder about its axis to first and second positions of the cylinder, respectively, and (iv.) a pair of first cam elements fixedly disposed externally on opposite sides of that portion of said body which contains the cylinder lock, said latch moving relative to said body and relative to said cams between said locking position and said released position, and (II.) a dead-bolt mechanism having (i.) base means providing a cavity shaped for guiding and admitting said cam-lock unit via an outer end of the cavity along the axis of said cylinder into the cavity and for total removal of the cam-lock unit from the cavity, (ii.) an abutment forming part of said base means, said abutment cooperating with said latch when insertion of the cam-lock unit into said cavity has been completed and when, thereafter, the cylinder lock has caused said latch to assume its locking position so as to prevent removal of said removable cam-lock unit from said base means, (iii.) a pair of oppositely reciprocable locking bolts having retracted positions and projected positions, said locking bolts having respective second cam elements adjacent said cavity and cooperable with said first cam elements, respectively, for driving said locking bolts to their projected positions when the cam-lock unit is being inserted into said cavity, and spring means for biasing said locking bolts to their retracted positions and for retracting said second cam elements toward each other when the cavity is empty, the foregoing apparatus being arranged so that the effort of inserting the cam-lock unit into the cavity develops balanced mutually opposite thrust of the first cam elements against the second cam elements as the cam-lock unit is being received in said cavity, thereby projecting said locking bolts oppositely to their door-securing positions, whereupon indexing of said cylinder by a key into said first position causes said latch to be disposed in its locking position and in cooperation with said abutment for locking the cam-lock unit against removal from the cavity, thereby locking said locking bolts in their projected positions.

5. Dead-bolt locking apparatus as in either claim 1 or 4 wherein said second cam elements are cam followers adjacent the outer end of said cavity where the cam-lock unit is initially admitted and wherein said first cam elements are cams having ramp surfaces that act against said cam followers at places that are progressively farther apart in accordance with their distances from the end of said cam-lock unit that initially enters said cavity.

6. Dead-bolt locking mechanism as in claim 5 wherein said cams include further cam surfaces that are essentially uniformly spaced apart where they are engaged by the first cam elements in the fully inserted position of the cam-lock unit.

7. Dead-bolt locking mechanism as in claim 4 wherein said locking bolts include mutually aligned locking portions and respective oppositely directed locking projections on said slide portions remote from said second cam elements, respectively, and wherein said base provides aligned slide bearings for said slide portions.

8. Dead-bolt locking mechanism as in claim 7 wherein said spring means comprises compression coil springs disposed about said locking projections and arranged to bias said slide portions toward said cavity.

9. Dead-bolt locking apparatus for releasably locking a door of an enclosure in closed position, said apparatus including a removable cam-lock unit having a key, a key-controlled cylinder lock, said cylinder lock including a cylinder, said cam-lock unit comprising a body portion containing said cylinder, said cylinder indexing about its axis relative to said body portion, and a latch operated by said cylinder between a projecting locking position and a released position retracted from said locking position in dependence on indexing of the cylinder to first and second positions, respectively, said body portion fixedly and externally bearing a first cam element and said latch moving relative to said body portion and relative to said first cam element between said locking position and said released position, and a dead-bolt mechanism having base means providing a cavity shaped for admitting and guiding said cam-lock unit into the cavity via an outer end of the cavity along the axis of said cylinder and for total removal of the cam-lock unit from the cavity, said dead-bolt mechanism providing an abutment which cooperates with said latch so as to prevent removal of said removable cam-lock unit from said base means when insertion of the cam-lock unit into said cavity has been completed and when, thereafer, the cylinder has been indexed and has thereby caused said latch to assume its locking position, a locking bolt having a retracted position and a projected position, said locking bolt having a second cam element adjacent said cavity and cooperable with said first cam element, and spring means for biasing said locking bolt to its retracted position and for biasing said locking bolt to its retracted position and for retracting said second cam element when the cavity is empty, the foregoing apparatus being arranged so that the effort of inserting the cam-lock unit into the cavity develops thrust of the first cam element against the second cam element in the direction to cause the locking bolt to become projected as the cam-lock unit is being received in said cavity, whereupon indexing of said cylinder in said body portion by said key into said first position causes said latch to be disposed in its projecting locking position and in cooperation with said abutment for locking the cam-lock unit against removal from the cavity, thereby locking said locking bolt in its projected position.

10. Dead-bolt locking mechanism as in claim 9 wherein said cylinder lock includes a lock shell within which said cylinder is rotatable, said shell being received in said body portion of the cam-lock unit so that the body portion including said first cam element is interposed between said shell and said locking bolt including the second cam element thereof.

* * * * *